US007896173B2

(12) United States Patent
Yamamoto et al.

(10) Patent No.: US 7,896,173 B2
(45) Date of Patent: Mar. 1, 2011

(54) SUPPORTING DEVICE FOR EXHIBITING A GOLF CLUB

(75) Inventors: Heihachiro Yamamoto, Tokyo (JP); Hitoshi Nishi, Sakura (JP); Yasushi Aoki, Tokyo (JP)

(73) Assignee: Waikeiwai Inc., Tokyo (JP)

( * ) Notice: Subject to any disclaimer, the term of this patent is extended or adjusted under 35 U.S.C. 154(b) by 461 days.

(21) Appl. No.: 11/630,690

(22) PCT Filed: Dec. 6, 2005

(86) PCT No.: PCT/JP2005/022737

§ 371 (c)(1),
(2), (4) Date: Dec. 27, 2006

(87) PCT Pub. No.: WO2006/077699

PCT Pub. Date: Jul. 27, 2006

(65) Prior Publication Data

US 2007/0158283 A1 Jul. 12, 2007

(30) Foreign Application Priority Data

Jan. 20, 2005 (JP) ..... 2005-039772

(51) Int. Cl.
*A47B 81/00* (2006.01)

(52) U.S. Cl. ..... 211/70.2; 248/214; 248/316.1

(58) Field of Classification Search ..... 211/13.1, 211/60.1, 62, 63, 64, 65, 70.2, 70.3, 70.5, 211/70.6, 70.7, 70.8, 85.7, 87.01, 94.01, 211/123; 206/315.2, 315.6, 349; 248/512, 248/534, 539, 214, 224.8, 309.1, 312, 314, 248/316.1; 224/547; D21/796
See application file for complete search history.

(56) References Cited

U.S. PATENT DOCUMENTS 149,275 A * 3/1874 Wilson ..... 248/222.51
222,961 A * 12/1879 Tattersley ..... 99/440

(Continued)

FOREIGN PATENT DOCUMENTS

JP B2 4-42925 7/1992

(Continued)

OTHER PUBLICATIONS

Office Action issued in U.S. Appl. No. 12/591,537 on Jul. 7, 2010.

*Primary Examiner*—Michael Safavi
*Assistant Examiner*—Joshua Rodden
(74) *Attorney, Agent, or Firm*—Oliff & Berridge, PLC

(57) ABSTRACT

A supporting device for exhibiting golf clubs enabling the easy dismounting and storing of the golf clubs from and onto the supporting device. The supporting device includes hook member and a connection member. When the clubs are hooked to the hook members, the clubs are always arranged in a specified direction at all times, and the supporting device for exhibition can be minimized in size and manufactured at low cost. The hook members are configured to let a user hang the clubs from the user's side. Also, the connection parts between the heads and the shafts of the clubs can be observed from the user's side and so as to support the heads and the shafts so that, when the clubs are suspended from the hook members, the clubs do not come out of the opening parts of the hook members.

2 Claims, 11 Drawing Sheets

U.S. PATENT DOCUMENTS

| | | | | | |
|---|---|---|---|---|---|
| 424,041 | A | * | 3/1890 | Ward | 211/63 |
| 1,418,093 | A | | 5/1922 | Parmater | |
| 1,575,270 | A | * | 3/1926 | Jankowsky | 211/87.01 |
| 1,678,353 | A | | 7/1928 | Reach | |
| 1,742,069 | A | * | 12/1929 | Greenwald et al. | 248/229.15 |
| 1,995,246 | A | * | 3/1935 | Merton | 211/94.01 |
| 2,448,752 | A | * | 9/1948 | Wagner | 248/512 |
| 2,539,336 | A | | 1/1951 | Sobers | |
| 2,722,431 | A | * | 11/1955 | Victor | 280/654 |
| 2,878,819 | A | * | 3/1959 | Thomas | 134/57 R |
| 2,880,012 | A | * | 3/1959 | Wilson | 280/47.19 |
| 3,139,132 | A | * | 6/1964 | Shiller | 206/315.6 |
| 3,503,518 | A | | 3/1970 | Black | |
| 3,667,078 | A | * | 6/1972 | Distasio | 15/104.92 |
| 4,157,803 | A | * | 6/1979 | Mack | 248/512 |
| 4,173,241 | A | * | 11/1979 | Stock | 206/315.6 |
| 4,193,495 | A | | 3/1980 | Keeley | |
| 4,195,677 | A | * | 4/1980 | Hagg et al. | 150/160 |
| 4,209,098 | A | * | 6/1980 | Adams | 211/70.8 |
| D255,819 | S | * | 7/1980 | Stock | D21/796 |
| 4,230,248 | A | * | 10/1980 | Finnegan | 224/323 |
| 4,747,025 | A | * | 5/1988 | Barton | 362/147 |
| 4,838,416 | A | * | 6/1989 | Carman | 206/315.2 |
| 4,988,007 | A | * | 1/1991 | Chiarot | 211/70.5 |
| 5,005,624 | A | * | 4/1991 | Sung | 150/160 |
| 5,054,627 | A | * | 10/1991 | Gregory | 211/94.01 |
| 5,238,109 | A | * | 8/1993 | Smith | 206/315.2 |
| 5,303,828 | A | * | 4/1994 | Paullin | 211/85.7 |
| D349,406 | S | | 8/1994 | Shumay | |
| D359,785 | S | * | 6/1995 | Kent | D21/796 |
| D362,289 | S | * | 9/1995 | Ratte | D21/796 |
| 5,617,951 | A | | 4/1997 | Wick | |
| 5,636,734 | A | | 6/1997 | Smith | |
| 5,715,952 | A | * | 2/1998 | Chichetti | 211/70.8 |
| 5,755,322 | A | * | 5/1998 | Yang | 206/315.2 |
| D394,957 | S | | 6/1998 | Hsu et al. | |
| D411,701 | S | * | 6/1999 | Klein et al. | D6/513 |
| 6,022,129 | A | * | 2/2000 | Tang | 362/404 |
| 6,085,901 | A | * | 7/2000 | Lin | 206/315.6 |
| 6,105,792 | A | | 8/2000 | Chang | |
| 6,152,313 | A | * | 11/2000 | Klein et al. | 211/113 |
| 6,161,691 | A | | 12/2000 | Ratcliff et al. | |
| 6,244,438 | B1 | * | 6/2001 | Weinmeier | 206/315.6 |
| 6,305,557 | B1 | * | 10/2001 | Brooks | 211/70.6 |
| 6,352,154 | B1 | * | 3/2002 | Miura | 206/315.6 |
| 6,536,588 | B1 | | 3/2003 | Kyrwood | |
| D474,933 | S | * | 5/2003 | Kaposi | D6/569 |
| 6,648,152 | B2 | * | 11/2003 | Bermes | 211/70.6 |
| 6,976,595 | B1 | * | 12/2005 | Geller | 211/94.01 |
| 7,014,052 | B2 | | 3/2006 | Dettorre et al. | |
| 7,114,622 | B2 | * | 10/2006 | Miranda et al. | 211/70.2 |
| 7,124,886 | B2 | * | 10/2006 | Heidenreich | 206/315.2 |
| D535,347 | S | * | 1/2007 | Cialdella et al. | D21/796 |
| 7,159,711 | B1 | * | 1/2007 | Gardner | 206/317 |
| 7,258,239 | B2 | * | 8/2007 | Kao | 211/70.6 |
| 2003/0047472 | A1 | | 3/2003 | Feeney | |
| 2004/0099624 | A1 | | 5/2004 | Hein | |
| 2004/0140281 | A1 | * | 7/2004 | Kutzke | 211/87.01 |
| 2005/0045571 | A1 | * | 3/2005 | Miranda et al. | 211/70.2 |
| 2007/0125729 | A1 | | 6/2007 | Krueger | |
| 2007/0193965 | A1 | * | 8/2007 | Cialdella et al. | 211/70.2 |
| 2007/0193966 | A1 | * | 8/2007 | Dettorre | 211/70.5 |
| 2008/0121597 | A1 | * | 5/2008 | Dientsmann et al. | 211/70.2 |
| 2008/0190795 | A1 | | 8/2008 | Shearon | |
| 2009/0095386 | A1 | * | 4/2009 | Martin | 150/160 |

FOREIGN PATENT DOCUMENTS

| | | |
|---|---|---|
| JP | A 11-249574 | 9/1999 |
| JP | A 2001-017288 | 1/2001 |
| JP | U 3079297 | 5/2001 |
| JP | A 2004-136069 | 5/2004 |

* cited by examiner

Prior Art

SUPPORTING DEVICE FOR EXHIBITING A GOLF CLUB

TECHNICAL FIELD

The present invention relates to a golf club display supporting device for displaying and exhibiting sporting goods such as golf products.

BACKGROUND ART

Most display fixtures have barely made any improvement for a long period of time. Some reasons for this are as follows:

1) Considerable effort has been made for the sales increase of goods by spending much money, while less effort has been made to improve the golf club display supporting device since little is known about how the display fixture contributes to sales increases.
2) At times, manufacturers of sporting goods have made goods display fixtures. In this case, display fixtures made by the manufacturer are small in quantity, expensive, and not frequently made, inevitably.
3) In supermarkets or department stores, the salesperson on the sales floor is able to create good ideas on improvement and enhancement of the goods display fixtures if he/she has time enough to do so.
4) Little development of goods display fixtures to attractively and effectively display and exhibit sporting goods has been made since the sporting goods industry was classified as the manufacturer to manufacture sporting goods and as the distributor to distribute the goods.

Those negative factors make it difficult for designers to design goods display fixtures suitable to the effective increase of the sales for sporting goods. Accordingly, an object of the present invention relates to a golf club display supporting device for displaying and exhibiting golf clubs, which involves a goods display fixture for displaying and exhibiting sporting goods, and to develop a goods display supporting device through the search of sales of the goods and checking for problems relating to the sales. Careful studying of the prior task as the background task presented the following conclusions.

The applicant of the present patent application proposed a unique display supporting device for display of golf clubs in Japanese Patent Publication TOKUKOUHEI No. 04-42925. The supporting device includes a combination of a base member made of metal or plastic and a surface ornamental member made of a resilient material such as synthetic resin or silicone resin. The display supporting device supports the golf club to be displayed in such a way that the grip of the golf club is inserted into a hollow member and the club shaft thereof is supported. FIG. 11 shows an example of a golf club display supporting device for golf club display that supports the golf clubs in such a way that the golf clubs are rested on the display supporting device and the club shafts of the golf clubs are supported at the middle and the heads are placed at the bottom of the structure. This example is a golf club display supporting device for supporting iron clubs, too.

Another golf club display supporting device as shown in FIG. 10 is also known. The display supporting device supports the club shaft of the wood golf club at two points. In the 2-point support method, it is essential that the club shaft be supported at two points, which are separated at a fixed distance from each other, setting aside the positions of those points. In this case, when the supporting members are separate from each other as described in the Japanese Patent Publication No. 04-42925, the effort to adjust those separate members in position and to fix them must be done, and further a member to do the work is needed.

In the case where the supporting member is one member as shown in FIG. 9, to fix the golf club, the distance between the supporting points must be long. In this circumstance, the resulting supporting device consisting of one member has a large size and is expensive, as a natural consequence. Further, the display supporting device is more distinguished than the golf clubs as display goods, and will impair the decorativeness of the display room.

For wood golf clubs, a mold is manufactured directly from club head itself. A concave part is formed in the mold for receiving the club head (convex part). The golf club display supporting device, formed by using the mold, receives the club head of the golf club at the concave part to firmly support the golf club. This type of golf club display supporting device is already utilized in the market as a ready-made fixture.

In the case of supporting the iron clubs for the display, the golf club display supporting device of the two-point support type as shown in FIGS. 10 and 11 has mainly been used. In FIG. 10, two pieces of holder planks each having a plurality of concave parts oppositely arranged are faced apart. Each golf club is bridged between two pieces of the holder planks in such a way that the club shaft of the golf club is supported at two points. In FIG. 11, the end of the grip of each golf club is placed in a convex part, and the club shaft of the golf club is supported by a support member having a plurality of concave parts.

DISCLOSURE OF THE INVENTION

Problems to be Solved

The method of supporting and fixing the club shaft or the grip of each wood golf club at two points needs a large supporting device. In this sense, it is very costly. The direction of the head of the golf club displayed is uncertain. Accordingly, when the customer picks up the golf club and returns it to the display supporting device, the club head is often returned in a different position than originally placed. Therefore, golf clubs are displayed with their heads being irregular in direction.

Also, for the method of firmly supporting the golf clubs by using the mold, in the case that three wood golf clubs are displayed while being arranged side by side by the golf club display supporting device, the mold itself become large in size, as shown in FIG. 9. In an effort to cope with this, if a designer wants to reduce the cost for the parts holding the club heads, additional problems arise in which the golf club shafts are not displayed in an orderly manner, and the three club shafts arranged side by side are going in all directions.

Also in the case of iron clubs supported at two points, when the display methods as shown in FIGS. 10 and 11 are used, the supporting of the iron clubs based on the two-point support is instable, and the club heads cannot be stably displayed. Even if the salesperson arranges the golf clubs to face the stamped brand names and the stamped manufacture names toward customers, after the customers pick them up from the club holder and examines it by practice swinging and detailed inspection, he/she would not put the golf club back in the desired position in many cases. Accordingly, the salesperson needs to put them back in the right positions.

For the reasons stated above, there is a demand for the development of such a golf club display holder that if the customer returns the golf club back in the original position, the golf club can be displayed in a desirable manner. Ten iron clubs are handled as one set, and it is vital to display those ten iron clubs as one set. The heads of the iron clubs are different from one another in shape. Therefore, to enhance decorative quality and display efficiency leading to sales promotion, new ideas must be developed.

Also when the golf clubs are vertically displayed as shown in FIG. 11, the two-point support method is basically used for supporting those clubs. Consequently, the golf club support is instable. Different club shaft lengths of the golf clubs result in different heights of the club heads. When the golf clubs look as they are in the photograph, no problem arises. When the club heads are directed in an alternative fashion, the display effects of the golf clubs suffers from less decorative qualities and less attractiveness to customers. To cope with this, the applicant of the present patent application filed a patent application, which is now disclosed and numbered as Japanese published application JP-A 2004-136069, as already referred. In this disclosed technology, a member for hooking the club, and a member for connecting and supporting a plurality of members, are separately formed. The hook member has a structure that is thick enough to form a concave part therein, and the club head is stably placed, as a convex part, in the concave part of the hook member. The material used for the hook member is an elastic material, such as rubber or silicone resin. The connecting member is made of metal or plastic material. The resulting golf club display supporting device is not large in size as a whole, and does not spoil the decorative quality of the materials displayed.

For wood golf clubs, it was found that when the club shaft is resiliently held along the club shaft while being in contact with only one point, both the face side and the wood face of the wood golf club, which are located on both sides of the club shaft, when the golf club is firmly held. A golf club display supporting device based on this fact found can stably and firmly support the golf club without increasing the structure size.

For iron clubs;

1) The iron clubs are displayed in a way that leaves club heads facing upward, and arranged in almost equal height, or in decreasing height in equal interval from one another.
2) To do, the club head is hung and supported at points and surfaces, and along a line connecting two points on the club shaft for display.
3) Brand logo, manufacturer logo, and/or other logos printed on the club head is fixed at a position to face the customer to make logos easily visible.
4) Golf clubs are arranged at fixed intervals and the club shafts are substantially parallel to one another.

The present invention aims to improve the golf club display supporting device disclosed in JP-A 2004-136069 to be easy to use. Such display supporting device is required to satisfy the following conditions:

1) The golf clubs should be displayed in an easily visible fashion.
2) After a customer picks up a displayed golf club, it is suggested that the customer return it to the original place.
3) It is much easier for the customer himself/herself to put the golf club back to the original position. Therefore, considering these three points, the object of the invention is to improve the conventional golf club display supporting device.

The golf club display supporting device disclosed in JP-A 2004-136069 is improved in the following points. First, the customer picks up the golf club from the hooking part and returns it to the original position, he/she has access to the display supporting device through the entrance of the guide part and hangs the club shaft. This entrance is located on the lateral side when viewed from front in the conventional display supporting device. Accordingly, when the customer returns it to the original position, the customer cannot see the opening part of the guide part from the front. The customer may pick up it from the original position by holding the club head of the golf club, but the customer does not have contact with the entrance of the guide part when he/she returns it. Accordingly, the customer finds difficulty inputting them back, and so he/she does not properly returns it back or just does not put it back at all. Especially, for the left handed person, the entrance is located on the right side, making it harder for the customer to place the golf club back in the original position.

Secondly, brand names and manufacturer names are stamped on the golf club head, and it is important that those are shown in a direction in which the customer can easily see. The joint part of the golf club ranging from the club head to the club shaft is a key part of the golf club since the golf club manufacture uses its ingenuity for the joint part in design and appeals to its originality. Manufacturer names are marked on some joint parts. In this respect, the golf club display supporting device is provided in which the joint part between the club head and the club shaft is seen from front.

Third, it is intended to create some means to suggest the customer to put back the golf club in original position, when he/she picks off the golf club from the display supporting device and returns it to the original position. Another object of the invention is to introduce the way to display golf clubs as small units for each kind of golf club type (such as by each coupling part).

DISCLOSURE OF INVENTION

To achieve the above points, there is a provided golf club display supporting device having hooking parts for hooking the club heads of golf clubs and a coupling part for coupling the hooking parts, wherein an entrance of a guide part of the hooking part for hanging the club shaft of the golf club is opened to the front side, to allow a customer to hang the club shaft of the golf club from the front.

It is important that the club shaft thus hung does not come off through the opening part. To do this, the club head is held from up to down by the hooking part. Further, when the club head of the golf club is supported by the hooking part, for wood golf clubs, a concavity of the hooking part is configured such that the gravity center of the golf club hung lies on almost the center of the club shaft or the gravity center where the club shaft comes in contact with the guide part for the hanging shaft when viewed from the front. For iron clubs, the face surface of the club head is received by the three surfaces of contact spots of the hooking part and by a surface containing a V-shape part or a U-shape part, and it is regulated by the guide part for hanging of the club shaft. In any case, the club grip of the golf club hung will swing in a direction opposite to the entrance of the guide part for hanging the club shaft thereby to ensure hanging stability.

In short, in the invention, the hooking part is configured such that the club head will not fall down from the holder to the front, when the club head is hung on the hooking part, as well as such that the club grip does not swing toward the front and does not come out from the hanging position by the shaft going toward the direction contacting with the back wall of the guide part.

An indication such as "out-of-stock" or "RENT" is marked on the surface of the hooking part for receiving the club head. The customer can see the indication when he/she picks up the golf club from the golf club display supporting device for a trial swing. The indication shows the customer that the display is not normal, and suggests the place to return after the golf club is used.

The golf clubs displayed on a plurality of hooking parts coupled to one coupling part are grouped into one kind of golf clubs, and this kind of golf clubs is displayed on a mini-information plate. For this reason, the guide part for attaching the mini-information plate to the hooking part is provided adjacent to the guide part for mounting the hooking part to the coupling part.

Additionally, means to reduce the cost are provided in order to make it easy for the customer to see the golf club display supporting device, and to utilize the golf club display supporting device.

EFFECTS OF THE INVENTION

The golf club display supporting device according to the invention is successfully improved over the golf club display supporting device filed by the applicant of the present patent application and now numbered as JP-A 2004-136069.

Specifically, the hooking part and the coupling part are separate members. Consequently, the golf club display supporting device requires less space to install. The golf clubs for sale on display are distinguished, and the easy selection of desired golf clubs by the customer is ensured.

The golf club display supporting device of the invention allows the customer to hang or pick up a golf club from the front side of the golf club display supporting device. Consequently, it is easy for the customer to pick up the golf club and return it to the original place. This advantage is added to that of JP-A 2004-136069. This feature relieves the salespersons' labor for goods arrangement. Further, the customer can see, from front, the joint part between the club head and the club shaft of the golf club, and the club shaft. With this, the customer easily confirms the feature of the golf club. This leads to the enhancement of quality of the golf club display supporting device. This feature encourages the customers to buy and contributes to sales promotion.

When the hung golf club is picked up, an indication such as "out-of-stock" appears, and it suggests the customer return it to the original place. Further, the mini-information plate displays a kind of displayed golf clubs hung in series on the flat bar of the coupling part, resulting in quality enhancement.

DETAILED DESCRIPTION OF THE PREFERRED EMBODIMENT

Figure 1:
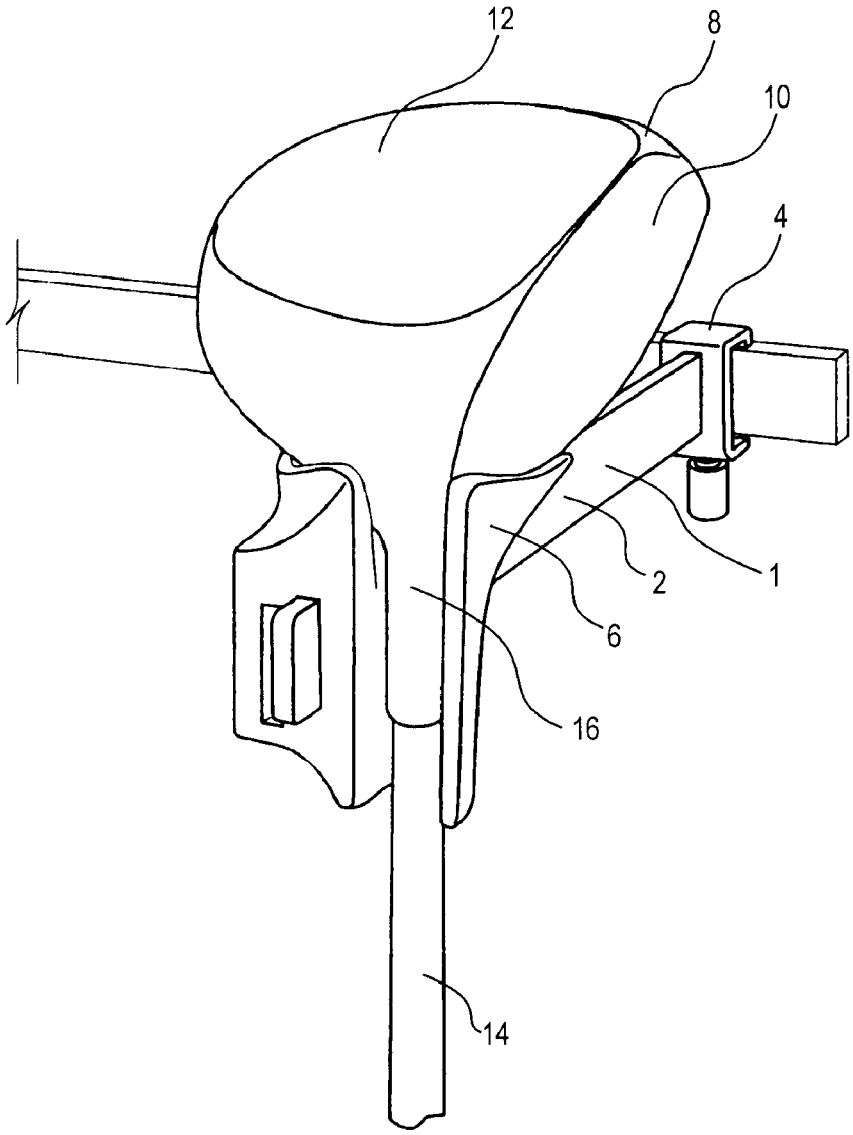
FIG. 1 is a view showing an external appearance of the golf club display supporting device for displaying golf clubs, which is an embodiment of the present invention, a wood golf club being hung from the golf club display support.

FIG. 1 is a view showing an external appearance of a golf club display supporting device for displaying golf clubs, which is an embodiment of the present invention, a wood golf club being hung from the golf club display supporting device. In the figure, reference numeral 2 designates a flat bar, and 4 is a fixing part 4. The flat bar and the fixing part cooperatively form coupling part 1. Reference numeral 6 is a hooking part, 8 is a wood golf club, 10 is a face part of the wood golf club, and 12 is a wood head thereof on which advertisement information is stamped. Reference numeral 14 indicates a club shaft of the wood golf club, and 16 is a joint part connecting the club head and the club shaft.

Figure 2:
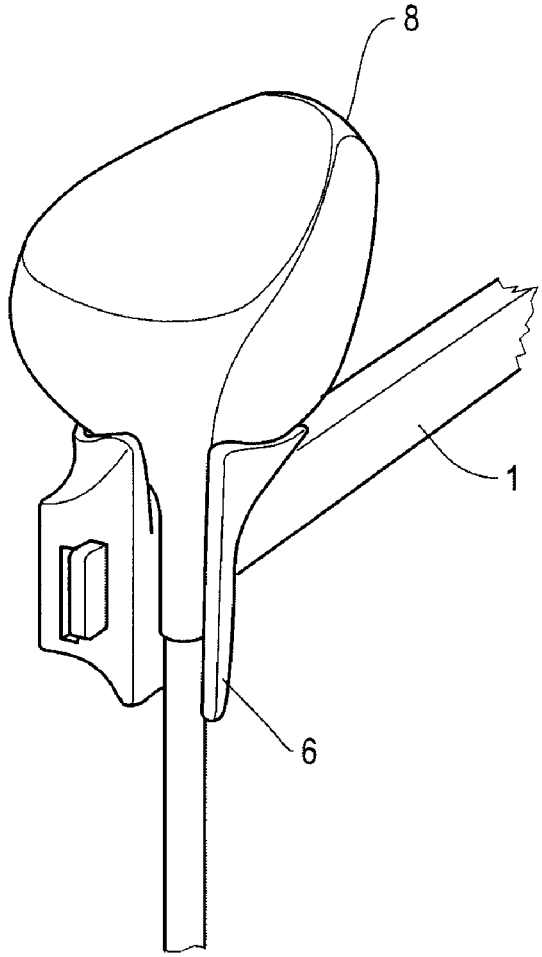
FIG. 2 is a view showing a photograph of a golf club display supporting device of FIG. 1.

FIG. 2 is a view showing a photograph of a golf club display supporting device from which a wood golf club is hung, which is shown in FIG. 1. Reference numerals used in the figure indicate the same portions as in FIG. 1.

Figure 3:
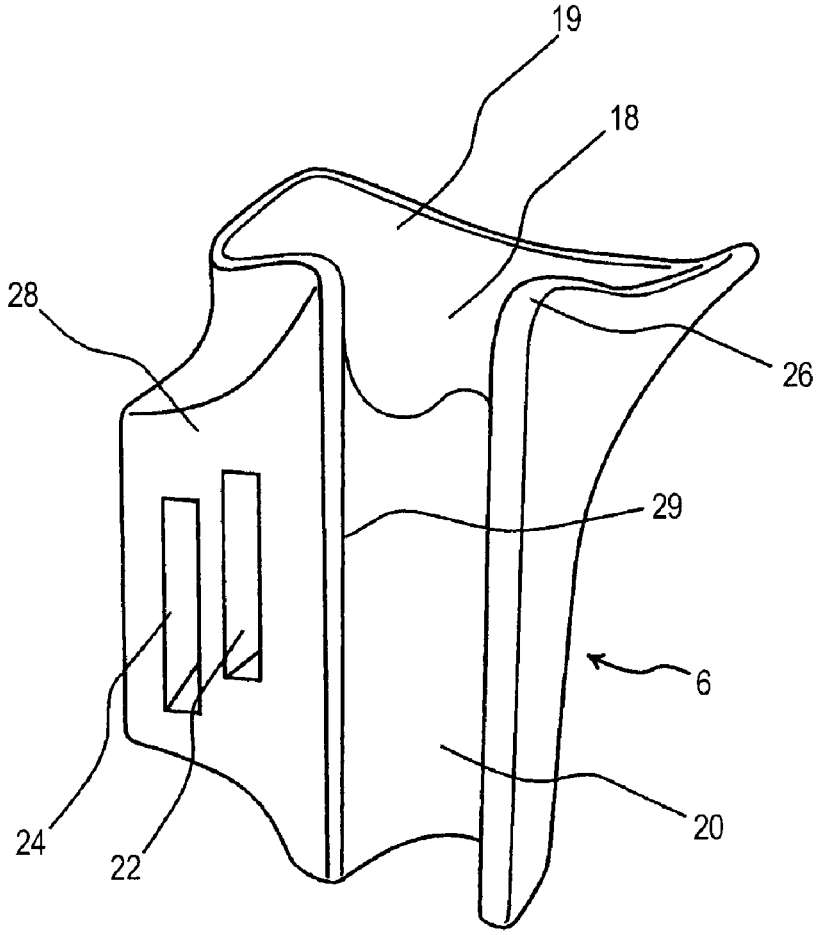
FIG. 3 is a view showing the details of the hooking part shown in FIG. 1.

FIG. 3 is a view showing the details of a hooking part 6 shown in FIG. 1.

In FIG. 3, reference numeral 18 designates a concavity 18 for receiving a wood head (convex part), and 20 is a guide part for receiving the club shaft of the wood golf club. 22 and 24 designate guide holes in which the flat bar of the coupling part is inserted for coupling. The guide hole 22 is coupled to the flat bar being horizontal to the floor surface. The guide hole 24 is coupled to the flat bar slanted.

In FIG. 1, one hooking part 6 is coupled to the coupling part 1 for simplicity and ease of explanation. Multiple hooking parts may be coupled to the coupling part, if necessary. The hooking part 6 is made of resilient rubber or plastic material. Accordingly, if the guide holes 22 and 24 are applied to the coupling part, those are firmly coupled, thereby to form a golf club display supporting device from which multiple golf clubs are hung.

The concavity 18 of the hooking part 6, which receives the wood head (convex part), is configured so that when the head (convex part) of each predetermined kind of wood golf clubs is hung, the convex part fits into the concavity and the head is stably placed therein. In a state that the hooking part 6 is attached to the coupling part 1 as shown in FIG. 1, an entrance of the guide part 20 to which the club shaft 14 will enter, is opened to the front side to allow the customer to access and to hang the wood golf club 8 from the hooking part, from the front side.

Accordingly, as shown in FIG. 3, the openings of the guide holes of the hooking part 6, which are provided for the coupling to the coupling part, and the opening of the guide part for club shaft hanging operation are oriented in substantially the same directions. As set forth in claim 1 of the present invention, the structure on the opening orientation is by way of example. In another example of the structure, another flat bar, which is short in length and similar in shape to the flat bar 2 of the coupling part 1 shown in FIG. 1, is mounted to the flat bar 2 by, for example, welding, at an angle of 90°. Also, the hooking part is coupled to this flat bar. In this example, the openings of the guide holes, which are provided for the coupling to the coupling part, and the opening of the guide part for club shaft hanging operation are substantially orthogonal in direction to each other.

In this case, the structure of the coupling part is complicated, and the cost becomes high. To avoid such disadvantages, structures having the openings oriented in substantially the same directions, which is shown in FIGS. 1 and 2, is most reasonable in manufacture in the light of cost and space saving.

The hooking part 6 shown in FIGS. 1 and 3 is provided with the concavity 18 for receiving the reverse side (convex part) of the wood golf club, to stably hold the hung wood golf club and to prevent the wood golf club from coming off through the opening of the guide part 20 for holding the club shaft.

The concavity 18 includes a support surface 19 for directly receiving the wood head (reverse side), a support surface 26 for supporting the face part 10 of the wood golf club 8, and a support surface 29 for supporting the joint part 16 which couples the wood head 12 with the club shaft 14 (reverse side of a surface 28 in FIG. 3).

The hooking part 6 is configured in such way that the gravity center of the wood golf club lies on an extended line of the club shaft vertically raised or the club shaft is slightly pressed against the wall of the guide part 20, which is opposite to the wall thereof defining the opening of the guide part.

With this structure of the hooking part 6, to hang the wood golf club 8 on the hooking part 6, the customer places the golf club head upward, holds and moves the club shaft 14 toward the opening of the guide part 20 from the front side, puts the club shaft 14 in the guide part 20, makes sure the club shaft 14 is in the guide part 20, and then gently drop down the wood golf club 8. In this way, the wood golf club 8 is hung on the hooking part 6 of the golf club display supporting device.

At this time, the reverse side (convex part) of the wood head 12 of the wood golf club 8 is supported by the support surface 19 of the hooking part 6, and the entire wood head 12 hangs while being supported by the support surface 19, a support surface 26 and a support surface 29.

The joint part 16 connecting the wood head 12 of the wood golf club 8 to the club shaft 14 is seen from the front, and the characteristics of the wood golf club 8 can be seen easily and instantly.

The wood head 12 is hung in a state that it is placed firmly within the concavity 18 of the hooking part 6. The gravity center of the wood golf club 8 hung lies substantially on the club shaft 14. However, the club shaft 14 is guided toward the back wall of the guide part 20 of the hooking part 6. The wood golf club 8, which have been hung on the hooking part 6, is stably hung.

In the case of FIGS. 1 and 2, the flat bar 2 of the coupling part 1 is oriented parallel to the floor surface. Some display locations require the following display of golf clubs. The fore end of the flat bar 2 is slanted toward the floor, and multiple golf clubs are displayed at multiple levels of height from low to high level, in order to provide better visual presentation of golf clubs. The height level of the golf club stepwise increases from the fore end of the flat bar to the rearmost end thereof. Specifically, a golf club that is hung at the fore end position of the flat bar is located at the lowest height level, and another golf club that is hung at the rearmost position of the flat bar is at the highest height level.

In an actual display, when the golf clubs displayed are of the same kind, there is no problem in using the horizontal type of flat bar to show the golf clubs in the same height. When the golf clubs displayed vary in types, the slanted type of flat bar is much easier to see each piece of golf club and also easy to pick out a desired golf club by making undulation.

The hooking part 6 of FIG. 3 is designed such that it is applicable to both the flat bars 2, which are horizontal and slanted to the floor surface. This feature successfully provides enhancement of production efficiency and cost efficiency, and better merchandise management of the hooking parts. The guide hole 22 is provided for the horizontal type of flat bar, and the guide hole 24 is for the slanted type of flat bar.

Figure 4:
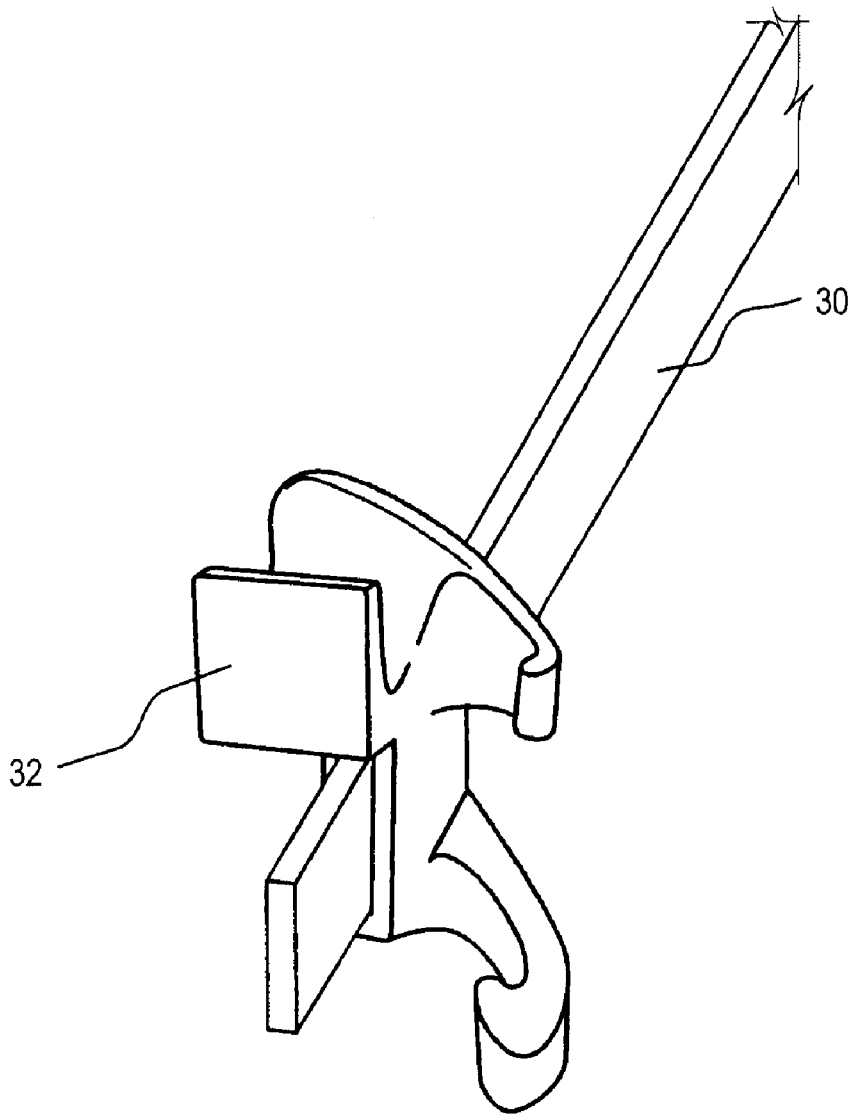
FIG. 4 is a view showing an external appearance of the golf club display supporting device for hanging iron clubs, which is an embodiment of the present invention.

FIG. 4 is a view showing an external appearance of a golf club display supporting device for hanging iron clubs, which is an embodiment of the present invention. In the figure, reference numeral 30 stands for a flat bar of a coupling part, and 32 is a hooking part.

Figure 5A:
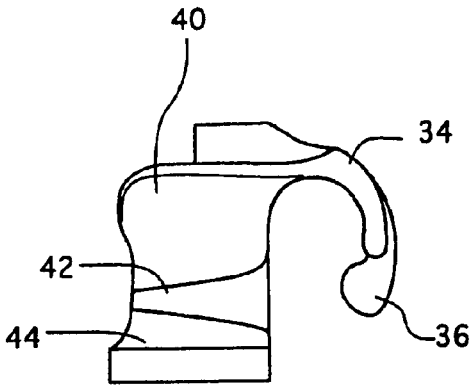
FIGS. 5A-5C are views showing an external appearance of the hooking part shown in FIG. 4, the view drawn by trigonometry.
Figure 5C:
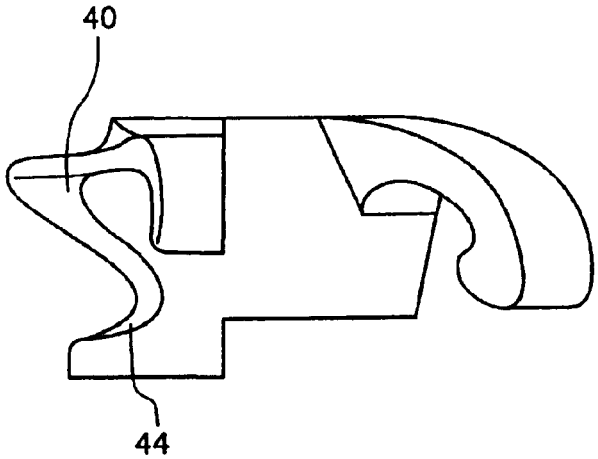
Figure 5B:
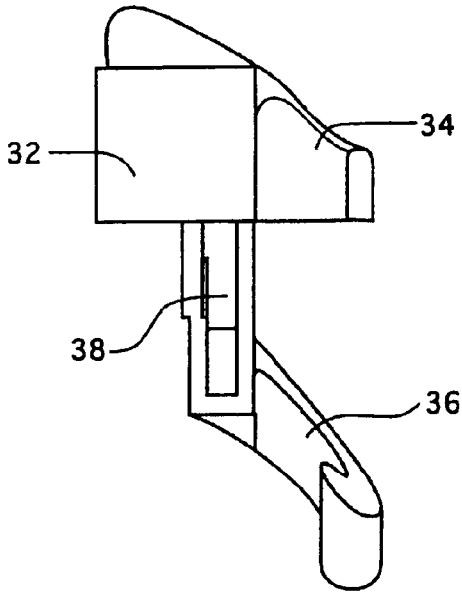

FIGS. 5A-5C are views showing an external appearance of the hooking part shown in FIG. 4, the view drawn by a trigonometry. FIG. 5A is a plane view. FIG. 5B is a front view. FIG. 5C is a right side view. In the figure, reference numerals 34 and 36 are guide parts on which club shafts are hung; 38 is a guide part connecting to the flat bar 30; and 40, 42 and 44 are support surfaces for receiving the iron clubs.

Figure 6:
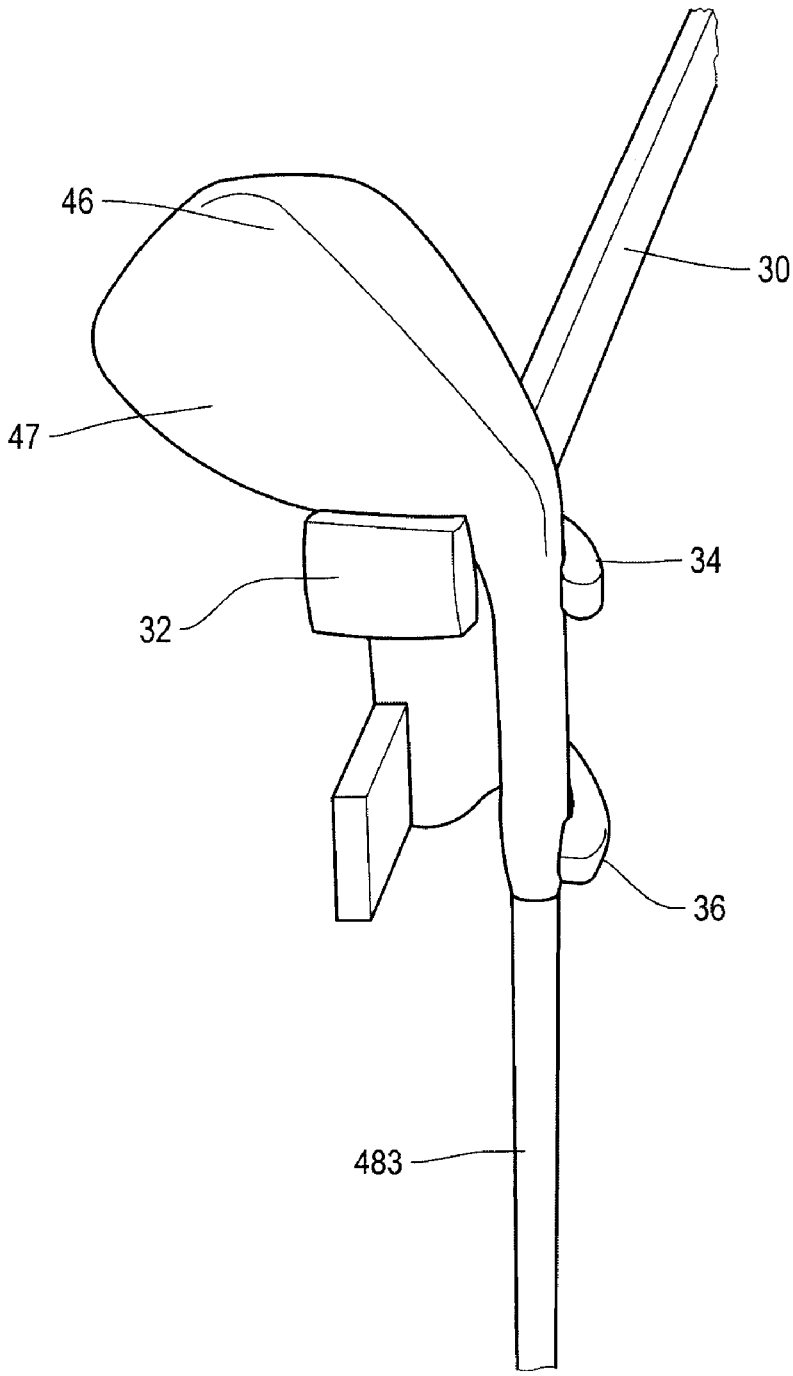
FIG. 6 is a view showing a photograph of the golf club display supporting device shown in FIG. 4 on which an iron club is actually hung.

FIG. 6 is a view showing a photograph of the golf club display supporting device shown in FIG. 4 on which an iron club is actually hung. In the figure, reference numeral 46 is an iron club and 48 is a club shaft. Other reference numerals indicate like portions in FIGS. 4 and 5A-5C.

As seen from FIGS. 5A-5C and 6, the hooking part 32 is constructed such that when the customer holds the iron club 46 with the club shaft 48 placed at the upper position, and hangs on the guide parts 34 and 36, the entrances of the guide parts 34 and 36 are faced to the front. Usually, the flat bar 30 of the coupling part is oriented to the front. Accordingly, the guide part 38 into which the flat bar is inserted for coupling, and the guide parts 34 and 36 are opened in the same directions.

The guide parts 34 and 36 face front, so that the traffic line of returning action is short. After the customer picks up the iron club 46 from the golf club display supporting device and examines it by practice swinging and detailed inspection, the customer can easily see the guiding opening during put back action, and all of such matters make it easy for a customer to place the golf club back in its original position.

Formerly, the guided opening was located on the right side as viewed from the front. Therefore, the customer could not see the opening, and thus it is very inconvenient for the customer to put back the used golf club in its original position. Especially, when the customer is aged or left-handed, it was very difficulty for the customer to return the used golf club to the original position. In this connection, in the invention, the opening is placed at the front. This feature enables such people to easily put the golf club back to the original position.

When the opening was placed in side, like previously, a message that the customer can pick up the golf club himself/herself was not transmitted to customer, and even in case that the message did transmit to customer, the customer could not understand how to pick it up. Thus, in this invention, the customer can very easily understand that the customer can easily pick up the golf club by himself, and can quite easily pick it out or put it back in original position.

As a result, the customer could pick up the golf club without any hesitation, and try its swing and inspect the golf club. The customer will probably put it back in the original position. This leads to much saving of salesperson's labor to reorganize the displayed golf clubs.

The hooking part 32 includes three support surfaces 40, 42, and 44 for receiving the club head 47 of the iron club 46, and the three surfaces of the club head which come into contact with the support surfaces when it is hung are supported by points, lines or surfaces. Particularly, those supporting surfaces 40, 42, and 44 are curved in cross section from a V-shape to a U-shape and slanted toward the guide parts 34 and 36. Accordingly, the iron club, when it is hung, is supported by the supporting surfaces 40, 42, and 44. Force acts on the iron club and the iron club slides down to the guide part located on the right side as viewed from front, while being regulated. Finally, the club shaft is brought into contact with the two guide parts 34 and 36 to be held thereat.

After all, the iron club 46 is hung so that it is supported by three support surfaces 40, 42, and 44 at points, along lines, or on surfaces, and the club shaft is regulated at the two points of the guide parts 34 and 36. Accordingly, the iron club does not come off from the front where the opening parts of the guide parts 34 and 36 are located.

One complete set of iron clubs consists of ten pieces of iron clubs #3, 4, 5, 6, 7, 8, 9, PW, AW, and SW. The shapes of those clubs and the joint parts to the club shafts are different from one another. In the invention, the way of supporting by the support surfaces 40, 42, and 44 of the hooking part is based on points, lines, or surfaces. Furthermore, the hanging spaces of the guide parts 34 and 36 are large enough to receive any kind of iron clubs. As a total function, the iron club is roughly controlled by the guide part 34 for controlling the club shaft, and the support surfaces 40 and 44 for controlling the club head direction, and the club shaft slides down into the guide part 36 on the slanted support surface 42. As a result, the golf club is vertically and firmly hung with no worry that the golf club shaft will fall from the front.

Figure 7:
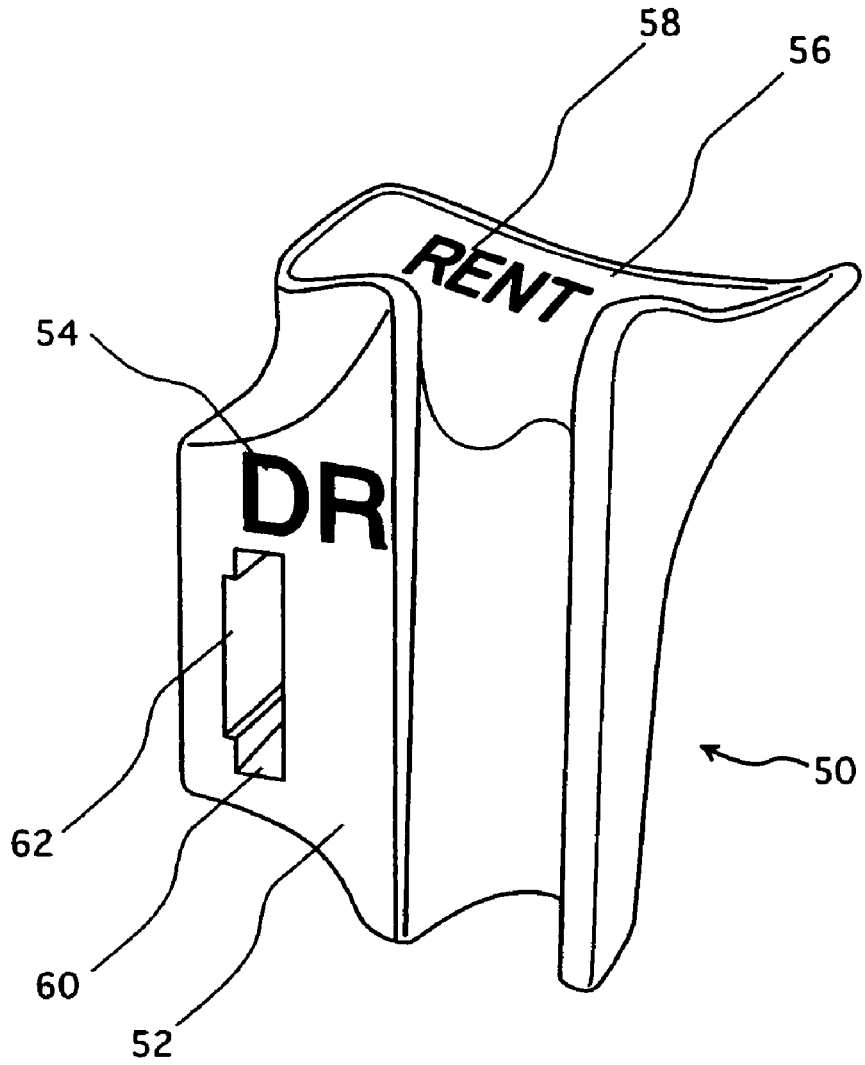
FIG. 7 is a view showing an external view of a hooking part of a wood golf club, which is an embodiment of the present invention.

FIG. 7 is a view showing an external view of a hooking part of a wood golf club, which is coupled to the coupling part 1 shown in FIG. 1, which is an embodiment of the present invention. In this embodiment, characters are printed on the surface of the coupling part made of rubber or plastic. A mini-information plate is attached adjacent to the guide part coupled to the coupling part 1.

In FIG. 7, reference numeral 50 is a hooking part; 52 is a display surface faced to the front; 54 is a manufacturer name; 56 is a concavity for receiving the head (convex part) of the wood golf club; 58 is a printed mark indicating "RENT" printed on the concavity; 60 is a guide part for receiving the coupling part; and 62 is a guide part for receiving an insert piece of a mini-information plate.

Figure 8:
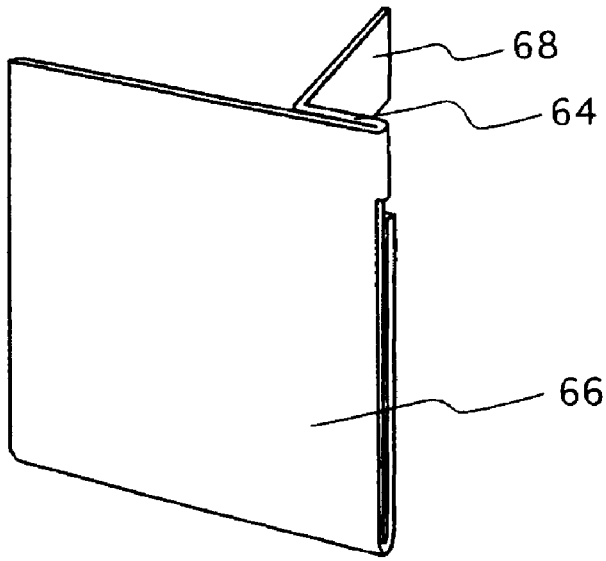
FIG. 8 is a view showing an external view showing a mini-information plate for explaining an embodiment of the golf club display supporting device according to the invention.
Figure 9:
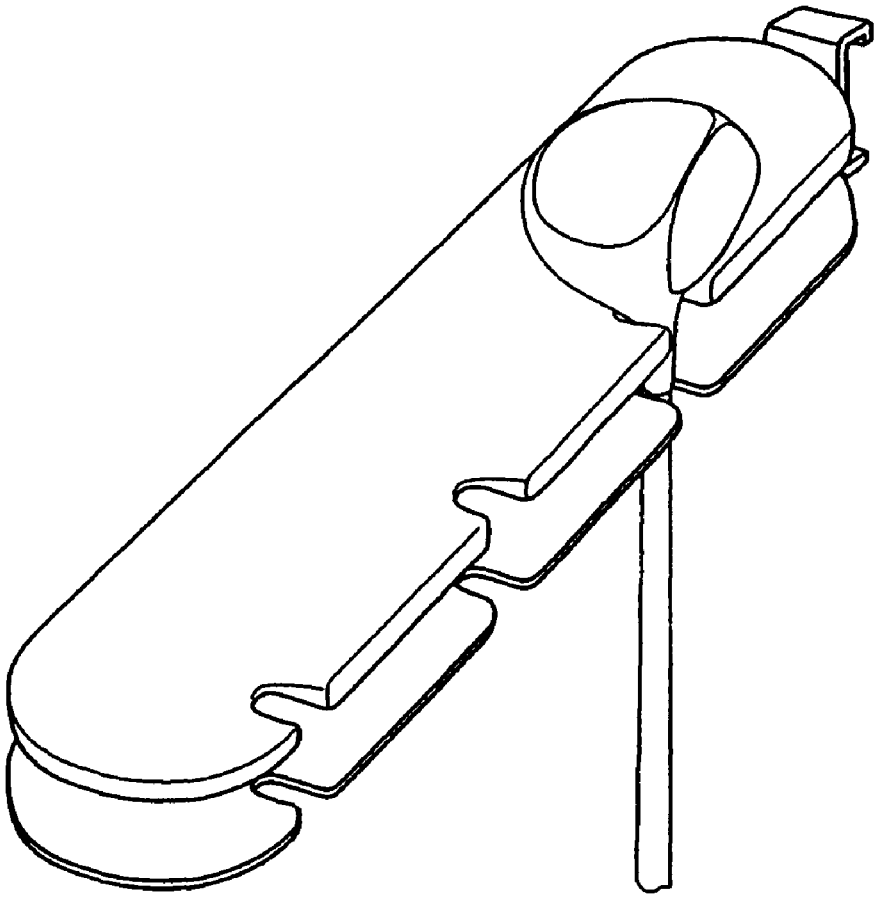
FIG.9 PRIOR ART
FIG. 9 is a view showing an external appearance of a conventional golf club display supporting device on which a wood golf club is actually hung.
Figure 10:
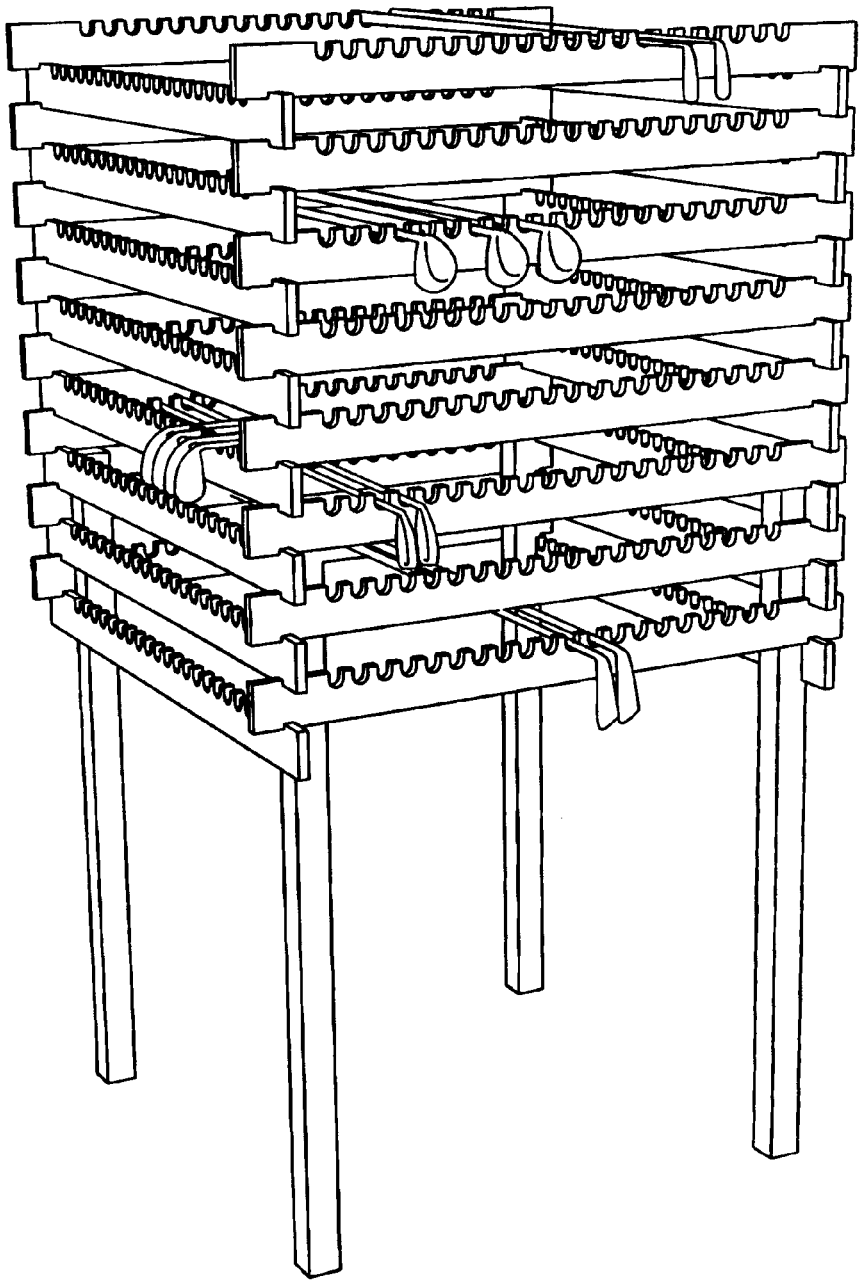
FIG. 10 is a view showing a conventional golf club display supporting device on which some golf clubs are put.
Figure 11:
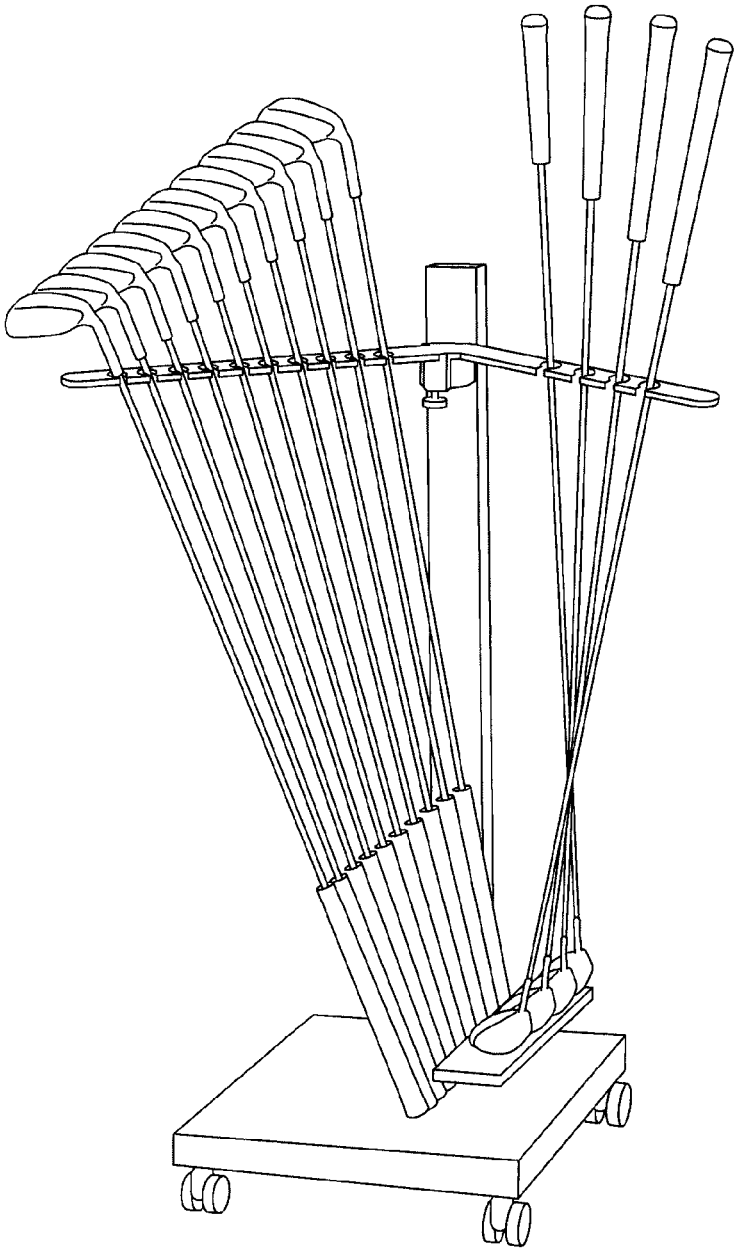
FIG. 11 PRIOR ART
FIG. 11 is a view showing another conventional golf club display supporting device on which iron clubs are displayed.

FIG. 8 is a view showing an external view showing the mini-information plate for presenting advertisement to be inserted into the guide part 62 of the hooking part 50. In the figure, reference numeral 64 is a mini-information plate, 66 is an advertisement surface; and 68 is the insert piece to be inserted into the guide part 62.

The hooking part 50 shown in FIG. 7 posts the name of the golf club manufacturer and the brand name of the golf club to make it easy to understand the displayed item. Also, when the customer picks up the golf club, the printed mark 58 of "RENT" appears, and by this, the customer is guided to put them back naturally in original position after use.

It is very important to show information, such as manufacturer's names, brand names, and kinds of the golf clubs, which are displayed on the multiple hooking parts coupled to the coupling part of the golf club display supporting device. Nevertheless, those are displayed floating, and thus indication by each coupling part was formerly very difficult. The front piece of the hooking parts coupled to the coupling part is constructed as shown in FIG. 7. The insert piece 68 of the mini-information plate 64 shown in FIG. 8 is inserted into the guide part 62, and the manufacturer name, brand name, kind of golf club, and additional catch-copies, CM, and the like are displayed on the advertisement surface 66 of the mini-information plate 64. Such display helps the customers for selection of golf clubs by clearly telling the difference.

INDUSTRIAL APPLICABILITY

The golf club display fixture shown in JP-A 2004-136069" is already widely used in golf shops, for sales promotion purpose, and in display units. As introduced above, it is certain that the invention of the present patent application will be further enforced and utilized in the golf club display world. It should be understood that the present invention is not limited to the embodiments described above, but the invention may be changed, modified, and altered within the true spirit of the invention.

The invention claimed is:

1. A golf club display supporting device for supporting a golf club, comprising:

at least one hooking part for hooking a club head of the golf club and hanging a club shaft of the golf club, the at least one hooking part including a front face, a guide part, a support surface and multiple guide openings or holes;

a coupling part for coupling with the at least one hooking part, wherein the coupling part comprises a flat bar and has a longitudinal length;

the front face of the at least one hooking part intersecting an outer portion of the coupling part along the longitudinal length of the coupling part;

the guide part comprising an entrance for hanging the club shaft, the entrance being provided in the front face of the at least one hooking part and opening towards the outer portion of the coupling part to allow a customer to hang the golf club from the front face in one action, wherein a joint part of the golf club connecting the club head to the club shaft is seen from the front face;

the support surface for supporting the joint part so as to partially hide the joint part when viewed from the front face; and the outer portion of the coupling part intersecting the at least one hooking part via said at least one of the multiple guide openings or holes in the at least one hooking part coupling the at least one hooking part to the flat bar of the coupling part, the multiple guide openings or holes being slanted at different angles with respect to a horizontal plane as viewed in a longitudinal direction of said flat bar.

2. The golf club display supporting device according to claim 1, wherein the golf club is a wood golf club having a weight, the club head includes a convex part, the at least one hooking part includes a concave part, when the golf club is hung on the at least one hooking part, the convex part of the club head fits into the concave part of the at least one hooking part and the weight of the golf club causes the club shaft to be pressed against the guide part so that the wood golf club is stably hung, and the at least one hooking part is constructed so that when the golf club is hung, an advertisement display printed on a surface of the wood golf club is facing the front face.

* * * * *